US007645963B2

(12) United States Patent
Werkman et al.

(10) Patent No.: US 7,645,963 B2
(45) Date of Patent: Jan. 12, 2010

(54) SOL-GEL BASED HEATING ELEMENT

(75) Inventors: Pieter Johannes Werkman, Singapore (SG); Gerard Cnossen, Drachten (NL); Marcel Rene Boehmer, Eindhoven (NL); Poh Loo Lee, Singapore (SG); Gim Hong Tan, Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 301 days.

(21) Appl. No.: 10/535,287

(22) PCT Filed: Oct. 29, 2003

(86) PCT No.: PCT/IB03/04865

§ 371 (c)(1),
(2), (4) Date: May 17, 2005

(87) PCT Pub. No.: WO2004/049761

PCT Pub. Date: Jun. 10, 2004

(65) Prior Publication Data

US 2006/0138121 A1 Jun. 29, 2006

(30) Foreign Application Priority Data

Nov. 22, 2002 (WO) ..... PCT/SG02/00302

(51) Int. Cl.
*H05B 3/02* (2006.01)
*H05B 3/16* (2006.01)

(52) U.S. Cl. ..... 219/543; 219/538

(58) Field of Classification Search ..... 219/543, 219/544, 542, 541, 540, 539, 538; 174/250; 338/307

See application file for complete search history.

(56) References Cited

U.S. PATENT DOCUMENTS

| | | | | |
|---|---|---|---|---|
| 4,074,001 | A * | 2/1978 | Imai et al. | 428/329 |
| 4,920,254 | A * | 4/1990 | DeCamp et al. | 219/547 |
| 5,322,075 | A * | 6/1994 | Deevi et al. | 131/194 |
| 5,908,585 | A * | 6/1999 | Shibuta | 252/506 |
| 5,993,973 | A | 11/1999 | Lee et al. | |
| 6,815,646 | B2 * | 11/2004 | Ito et al. | 219/444.1 |
| 6,919,543 | B2 * | 7/2005 | Abbott et al. | 219/543 |
| 6,963,054 | B2 * | 11/2005 | Couraud | 219/543 |
| 2002/0096512 | A1 * | 7/2002 | Abbott et al. | 219/543 |

FOREIGN PATENT DOCUMENTS

| | | | |
|---|---|---|---|
| EP | 0336436 | A2 | 10/1989 |
| EP | 0390163 | A1 | 10/1990 |
| EP | 0640669 | A2 | 3/1995 |
| EP | 0880302 | A2 | 11/1998 |
| WO | 199629447 | | 9/1996 |
| WO | 199711040 | | 3/1997 |
| WO | 2002072495 | A2 | 9/2002 |
| WO | 2002085072 | A1 | 10/2002 |

OTHER PUBLICATIONS

David Barrow; "Applications of Composite Sol-Gel Coatings", Journal of the Danish Ereamic Society, vol. 5, No. 1, 2002.

C. Jeffrey Brinker et al; "Sol-Gel Science", Gulf Professional Publishing, Apr. 28, 1990, ISBN0121349705, 9780121349707, pp. 112-116.

* cited by examiner

*Primary Examiner*—Daniel L Robinson

(57) ABSTRACT

A heating element includes an electrically insulating layer and an electrically conductive layer. At least the electrically conductive layer is based on a hybrid sol-gel precursor including an organosilane compound.

18 Claims, 1 Drawing Sheet

SOL-GEL BASED HEATING ELEMENT

The present invention relates to a heating element comprising an electrically insulating layer and an electrically conductive layer, as well as to an electrical domestic appliance comprising such a heating element.

In general a (flat) heater system comprises two functional layers applied on a substrate, namely an electrically insulating layer and an electrically conductive layer. The electrically conductive layer in the above-mentioned heating element generally comprises a layer with a high ohmic resistance, the resistive layer, as well as a layer with a lower ohmic resistance, which acts as a contacting layer. Heat is generated by passing an electrical current through the resistive layer. The function of the insulating layer is to isolate the heat-generating resistive element from the substrate, which may be directly accessible from the outside.

The invention specifically relates to a flat heating element that is suitable for high power densities, for instance for application in laundry irons and other domestic appliances.

Thick-film processing for making flat heating elements involves curing steps, which should be limited to a temperature compatible with the substrate. For aluminum substrates, the maximum curing temperature is rather low, and therefore flat-heating materials based on glasses are generally not suitable. Low melting point glasses often contain lead or other undesired metals, which are to be avoided, and they have a significantly lower thermal expansion coefficient than aluminum and aluminum alloys. Polymer-based materials, such as epoxies, or silicone resins do not have a sufficient temperature stability for them to be used in a heating element. An important factor in this respect is the temperature drop across the insulating layer, which can be quite substantial and which depends on the thickness of the electrically insulating layer. This makes polymer-based materials especially unsuitable for high power densities, where the track temperatures can easily be about 100° C. higher than the heating face of the substrate for an insulating layer that is only 50 μm thick.

WO 02/072495 discloses a composition for application to a substrate to form an electrically conductive coating thereon. The composition includes a sol-gel solution filled with conductive powder. The sol-gel solution comprises a non-hybrid sol-gel, such as alumina sol-gel or silica sol-gel. WO02/072495 also discloses a heating device comprising the above composition, in which a thick insulating layer of up to about 500 μm is applied. In order to protect the conductive layer against oxidation, an oxidation barrier layer has to be applied over said conductive heating layer. This treatment makes the device less sensitive to corrosion but introduces extra processing steps.

The present invention aims to provide a heating element according to the preamble which does not have the above disadvantages and which provides a relatively high power density. Moreover, the present invention aims to provide a heating element that can advantageously be applied on aluminum and aluminum alloy substrates.

To this end the present invention provides a heating element comprising an electrically insulating layer and an electrically conductive layer, wherein at least the electrically conductive layer is based on a hybrid sol-gel precursor comprising an organosilane compound.

By applying such a hybrid sol-gel precursor, a heating element can be provided with higher power densities and a reduced risk of oxidation of the conductive layer. The hybrid sol-gel precursors as disclosed in the present invention differ from the non-hybrid precursors as disclosed in WO 02/072495. The hybrid sol-gel precursors as used herein can be characterized as compounds comprising silicon, which is bound to at least one non-hydrolyzable organic group, and 2 or 3 hydrolyzable alkoxy groups. The application of the hybrid sol-gel precursors according to the present invention results in a heating element with very advantageous properties.

According to the present invention, at least the electrically conductive layer is based on a hybrid sol-gel precursor. Advantageously, also the electrically insulating layer is based on a hybrid sol-gel precursor. Such an electrically insulating layer is also disclosed in WO 02/085072.

The sol-gel material according to the present invention can be processed at temperatures below 450°, which makes them suitable to be applied directly to aluminum substrates. Although the sol-gel material is especially suitable for application on aluminum or aluminum alloy substrates, other substrates that are conventionally used for heating elements and that are compatible with the final utility may also be used. Said substrates may comprise, for example, stainless steel, enameled steel, or copper. The substrate may be in the form of a flat plate, a tube, or any other configuration that is compatible with the final utility.

In particular, the hybrid sol-gel precursor comprises an organosilane compound from the group of alkyl-alkoxysilanes.

Preferably, the hybrid sol-gel precursor comprises methyl-trimethoxysilane and/or methyl-triethoxysilane.

The hybrid sol-gel precursors according to the present invention should be used in order to obtain a heating element with a relatively high power density, a reduced risk of oxidation of the resistive layer, and optimized thermal expansion coefficient values for aluminum and aluminum alloys. Hybrid sol-gel precursors such as methyl-trimethoxysilane (MTMS) and methyl-triethoxysilane (MTES) are known to have an excellent temperature stability up to at least 450° C. Moreover, MTMS has been shown to prevent silver oxidation and subsequent migration effectively. The carbon content of these materials is still low, so carbonized conductive tracks across the insulating layer will not form after failure, resulting in a safe flat heating element. The maximum layer thickness of coatings made from hybrid precursors is relatively high, compared with the maximum layer thickness of coatings made from non-hybrid sol gel materials. Therefore the layers can be deposited in one or at most two steps without intermediate curing.

Advantageously, the electrically insulating layer comprises non-conductive particles.

A fraction of said non-conductive particles preferably have a flake-like shape and a longest dimension of 2-500 micrometers, preferably from 2-150 micrometers, and more preferably from 5-60 micrometers. These flake-like non-conductive particles are based on oxidic materials such as, for example, mica, or clay, and/or surface-modified mica or clay particles with a coating of titanium dioxide, aluminum oxide and/or silicon dioxide. The flake-like material content in the insulating layer should be less than 20%, preferably less than 15%, and more preferably 4-10% by volume.

An advantage of such anisotropic particles is that their presence prevents the formation of cracks in the electrically insulating layer after frequent heating up and cooling down of the heating element.

In the preferred embodiment, the other non-conductive particles are present in a colloidal form. Examples thereof are oxidic materials like aluminum oxide and silicon dioxide. Preferably, the aluminum oxide content in the insulating layer should be less than 40%, preferably less than 20%, more preferably 10-15% by volume. As for the silicon dioxide content in the insulating layer, it should advantageously be less than 50%, preferably less than 35%, more preferably 15-25% by volume.

If an insulating layer based on MTMS or MTES filled with particles, including anisotropic particles, is made, a layer thickness of just 50 μm can withstand 5000V. This relatively small layer thickness allows the temperature of the resistive track to be fairly low. For a specific high power density application of 50 W/cm$^2$ that requires a heating face temperature of 250° C., a conductive track temperature of only 320° C. is required. By contrast, an excess temperature of the heat-generating conductive layer of about 600° C. would be required for an insulating layer thickness of 300 μm. For this reason said thin insulating layers are advantageously used. The layers can be applied by any wet chemical application method, preferably spray coating or screen printing followed by a curing step.

The heating elements according to the present invention are very suitable for use as heating elements in laundry irons, especially for the controlled formation of steam, for which high power densities are required. However, the heating elements are also very suitable for other domestic appliances, like hair dryers, hair stylers, steamers and steam cleaners, garment cleaners, heated ironing boards, facial steamers, kettles, pressurized boilers for system irons and cleaners, coffee makers, deep-fat fryers, rice cookers, sterilizers, hot plates, hot-pots, grills, space heaters, waffle irons, toasters, ovens, or water flow heaters.

The heating element according to the present invention as well as the processing steps for providing said heating element will be described in more detail below by way of example.

The materials and processes are designed for applying a thin heating element to a metal substrate such as aluminum. A hybrid sol-gel solution, made preferably of MTMS or MTES, water and filled with oxidic particles such as silica, alumina and titania is prepared for the insulating layer by hydrolysis using a suitable acid. It was found to be specifically beneficial to include strongly anisotropic particles, such as mica or commercially available interference pigments, in the formula to maintain high dielectric breakdown strengths during use. This coating liquid can be applied to an aluminum substrate, preferably an anodized aluminum substrate, to ensure good adhesion of the sol-gel layer. Normally two layers are sprayed, with a short intermediate drying step, but without the need of an intermediate curing step. This leads to a final coating layer thickness of about 50 μm. Advantageously, the insulation layer has a thickness of 25-100 μm, preferably 35-80 μm.

Curing takes place at a temperature of around 415° C., depending on the substrate and application requirements.

A conductive layer or track is applied on top of the insulating layer. Advantageously, the electrically conductive layer comprises conductive and/or semi-conductive particles, as well as an amount of insulating particles of 0-20% by volume. The insulating particles may be added to modify the resistance of the layer or track.

Advantageously, the electrically conductive layer does not exceed 30 μm in thickness and preferably does not exceed 15 μm in thickness.

The preferred technique for applying the conductive tracks is screen printing. Commercially available metal powders can be used for the conductive track. It is preferred to use silver or silver alloy particles. Mixing of the silver particles with palladium particles or the use of silver-palladium alloys both lead to a change in resistivity while the positive temperature coefficient value is reduced. Graphite may also be used to advantage to make conductive tracks. Other metals and semiconductors may be used in making conductive layers for the application, provided they have a sufficiently high temperature stability in the hybrid sol-gel matrix. The use of MTMS or MTES precursors reduces the rate of oxidation of silver and graphite particles at the high temperatures in application. In that respect it can be noted that graphite in an MTES-derived matrix has shown a long-term stability (over 600 hours) at 320° C.

The conductivity achieved depends on the volume fraction of conductive particles in the conductive layer, and can be further influenced by the addition of non-conductive particles. The addition of non-conductive particles may either increase or decrease the layer conductivity.

To make the formula screen-printable, a cellulose derivative is added to the particle-containing, hydrolyzed MTMS or MTES solution. Hydroxy-propyl-methyl-cellulose is preferably used as the cellulose material. Finally a solvent with a high boiling point is added to prevent drying of the ink and subsequent clogging of the screen. Butoxyethanol was found to be a suitable choice, but other polar solvents, preferably alcohols, are also appropriate.

A protective layer to prevent corrosion is not needed on this stack of layers. However, for the sake of mechanical integrity during handling and production it may be beneficial to deposit such a layer. Using for instance a silica-filled hybrid sol-gel solution based on, for example, MTMS, a screen printable formula can be easily made. The applied topcoat layer can be co-cured with the conductive layers.

The heating elements thus prepared were subjected to over 600 temperature cycles in which the element was maintained at 320° C. for 1 hour, and subsequently switched off during 30 minutes. The high temperature was obtained bypassing an electrical current through the conductive layers, by which power densities of 10 to at least 120 W/cm$^2$ could be achieved.

The invention will be further elucidated with reference to the following embodiment, the following manufacturing examples, and the enclosed drawing, in which.

It is noted that the various elements are purely schematic and are not drawn to scale.

Figure 1:
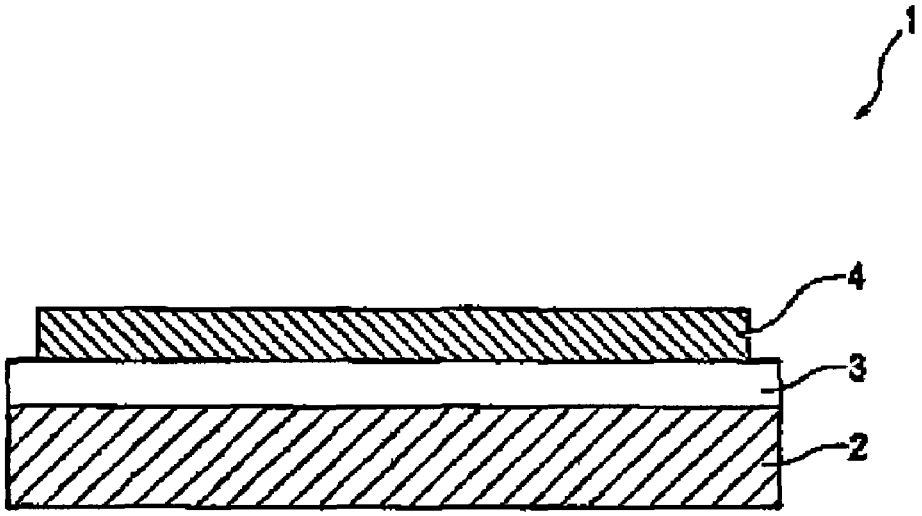
FIG. 1 is a sectional view of an embodiment of the heating element according to the present invention.

The heating element 1 as shown in FIG. 1 is built up of a substrate 2, an insulating layer 3, and an electrically conductive layer or resistive layer 4.

In the embodiment shown, the substrate 2 comprises aluminum or an aluminum alloy which is used for a sole plate of an iron. Said substrate 2 is covered with a layer 3 of an electrically insulating material. In the example, the electrically insulating layer 3 is based on a hybrid sol-gel precursor and has a thickness of 50 μm. The resistive layer 4 comprises a track of a conductive coating—not specifically shown in the Figure—with a high ohmic resistance, which is, in the present example, screen-printed on the insulating layer 3.

EXAMPLE 1

A lacquer was prepared from 32.82 g of MethylTriMethoxySilane (MTMS) 12.62 g aluminum oxide CR6 (Baikalox), 16.41 g ethanol, 0.31 g maleic acid, and 34.95 g of a colloidal silica suspension Bindzil 40NH3/80 (EKA Chemicals). The water from the silica suspension was used to hydrolyze the alkoxysilanes. 2.89 g of a commercially available flake-like, mica based pigment was added to the lacquer to reduce the sensitivity to crack formation.

After completion of the hydrolysis reaction, the lacquer was spray-coated onto a 3 mm thick, anodized aluminum substrate. The anodic layer thickness was less than 4 microns and served as a primer layer for the sol-gel insulating layer.

The layers were subsequently cured at 415° C. to obtain a dry film thickness of 50 μm. The dielectric strength of this layer is higher than $10^8$ volt/m. This coating was able to withstand more than 1000 cycles of heating-up to 320° C. and cooling-down to room temperature. After 1000 cycles, still no crack formation was observed and no deterioration of the dielectric breakdown strength was measured.

COMPARATIVE EXAMPLE 1

A coating similar to that in example 1 was prepared, except for the addition of the flake-like pigment to the lacquer. The dielectric strength of this layer is higher than $10^8$ V/m. This coating was able to withstand only 300 cycles of heating-up to 320° C. and cooling-down to room temperature. After 300 cycles a severe crack formation was observed, leading to breakdown voltages of less than 600 V, which is too low for application in domestic appliances.

EXAMPLE 2

A heating element was prepared starting from an aluminum substrate provided with an insulating layer as described in example 1. Onto this layer a conductive track was printed using a paste prepared according to the recipe given below.

A hydrolysis mixture was prepared from 84.8 g methyltriethoxysilane, 51.2 g water, and 0.24 g glacial acetic acid. The mixture was stirred continuously for 5 hours. 3.85 g Disperbyk 190 was added to 36 g of this hydrolysis mixture followed by 77.8 g of a commercially available silver powder with a particle size below 20 μm. Subsequently 36 g n-propanol was added to the mixture, which was subsequently ball-milled overnight on a roller conveyor.

After removal of the milling balls, 35 g of a 6% hydroxypropyl-methylcellulose solution in water was added to 120 g of the mixture. After mixing a homogeneous paste was obtained which was screen-printed on said insulating sol-gel layer. The layers were dried at 80° C. and subsequently cured at 415° C. A single layer had a thickness of about 5 μm and a sheet resistance of 0.046 Ω per square. The quality was such that the sample-to-sample variation of the sheet resistance was less than 5%. The heating element was powered up actively by application of an electrical current through said conductive layer to obtain a temperature of 320° C. The sheet resistance was found to decrease to a plateau value of about 20% below the initial resistance value after prolonged exposure to said temperature. This plateau value was reached within 60 hours of exposure to said temperature.

EXAMPLE 3

A similar heating element as described in example 2 was prepared, except for the fact that the conductive layer printing was repeated after drying of the first printed conductive layer. After drying and curing of the conductive layer stack, a layer thickness of 10 μm was measured. The double-pass printed conductive layers had a sheet resistance of 0.024 Ω per square. The quality was such that the sample-to-sample variation of the sheet resistance was less than 5%. The heating element was powered up actively by application of an electrical current through said conductive layer to obtain a temperature of 320° C. The sheet resistance was found to decrease to a plateau value of about 20% below the initial resistance value after prolonged exposure to said temperature. This plateau value was reached within 60 hours of exposure to said temperature.

EXAMPLE 4

A heating element was prepared starting from an aluminum substrate provided with an insulating layer as described in example 1. Conductive and contacting tracks were printed onto this layer, using paste materials prepared according to the recipes given below.

A hydrolysis mixture was prepared from 56.0 g methyltriethoxysilane, 33.8 g water, and 0.16 g glacial acetic acid. The mixture was stirred continuously for 5 hours, after which 7.95 g of Disperbyk 190 was added followed by 31.74 g graphite powder with a particle size of around 10 μm.

The mixture was ball-milled overnight on a roller conveyor. After removal of the milling balls, 60 g a 6% hydroxypropyl-methylcellulose solution in water was added to 100 g of the mixture, followed by 50 g n-propanol. After mixing, a homogeneous paste was obtained which was screen-printed on said insulating sol-gel layer to form a conductive layer.

After drying of the conductive layer, a contacting layer based on the recipe disclosed in example 2 was screen-printed on said substrate. The contacting layer partly overlapped the conductive layer to form a low-ohmic contact.

The screen-printed layers were dried at 80° C. and subsequently cured at 415° C. A layer thickness of about 5 μm was obtained with single pass printing. The sheet resistance of the conductive layer was 57 Ω per square. The quality was such that the sample-to-sample variation of the sheet resistance was less than 10%. The heating element was powered up actively by application of an electrical current through said conductive layers to obtain a temperature of 320° C. Prolonged exposure to said temperatures did not show any significant change in sheet resistance.

EXAMPLE 5

A similar heating element as described in example 4 was prepared, except for the fact that the contacting layer was applied before the conductive layer. The sheet resistance of the conductive layer was 57 Ω per square. The quality was such that the sample-to-sample variation of the sheet resistance was less than 10%. The heating element was powered up actively by application of an electrical current through said conductive layers to obtain a temperature of 320° C. Prolonged exposure to said temperatures did not show any significant change in sheet resistance.

EXAMPLE 6

A similar heating element as described in example 4 was prepared, except for the fact that the conductive layer printing was repeated after drying of the first printed conductive layer. After drying and curing of the conductive layer stack, a layer thickness of 10 μm was measured. The double-pass printed conductive layers had a sheet resistance of 26 Ω per square. The quality was such that the sample-to-sample variation of the sheet resistance was less than 10%. The heating element was powered up actively by application of an electrical current through said conductive layers to obtain a temperature of 320° C. Prolonged exposure to said temperatures did not show any significant change in sheet resistance.

EXAMPLE 7

A heating element was prepared starting from an aluminum substrate provided with an insulating layer as described in example 1. A conductive track was printed onto this layer, using a paste prepared according to the recipe given below.

To 16 g the hydrolysis mixture as described in example 4, 1.7 g Disperbyk 190 was added, followed by 35 g a commercially available silver powder (particle diameter smaller than 20 μm), 1.35 g $Al_2O_3$ (Baikalox CR6), and 16 g 1-propanol. This mixture was ball-milled overnight. After removal of the milling balls, 13 g a 6% HPMC solution in water was added, and the resulting paste was screen-printed onto said insulating sol-gel layer. After drying at 80° C. and curing at 415° C., a layer thickness of 6 μm resulted with a sheet resistance of 0.07 Ω per square.

EXAMPLE 8

A flat heating element was prepared according the description in example 2, with the difference that a hybrid topcoat layer was printed after printing of the conductive layer.

The topcoat was prepared from a hydrolysis mixture based on 37.35 g methyltriethoxysilane, 22.55 g water, and 0.10 g glacial acetic acid. The mixture was stirred continuously for 5 hours, after which 9.6 g Disperbyk 190 was added, followed by 41.0 g titanium dioxide powder with a particle size of around 250 nm. The mixture was ball-milled overnight on a roller conveyor. After removal of the milling balls, 36 g of a 6% hydroxypropyl-methylcellulose solution in water was added to 60 g of the suspension, followed by 30 g n-propanol. After mixing, a homogeneous paste was obtained which was screen-printed over the complete flat heating element except for two contacting pads. The topcoat screen-printing step was carried out before said curing treatment of the conductive layer. After drying at 80° C., the complete coating stack was cured at a temperature of 350° C.

The measured resistance of the conductive track was 0.047 Ω per square.

EXAMPLE 9

A flat heating element was prepared according to the description in example 2, with the difference that a defect in the conductive layer was induced by means of the placement of a human hair on the substrate before the application of the conductive layer. After the conductive layer had been printed, the human hair was removed, leaving behind a defect in the conductive layer.

The heating element was subsequently dried at 80° C. followed by a curing step at 350° C.

Next the heating element was powered up by application of a current of 9 A induced by an alternating voltage difference of 220 V. Sparking of the element was observed at the position of the hair defect in the conductive layer, leading to failure of the element. The quality of the insulating layer was tested by application of a potential difference of 1250 V between the conductive track and the aluminum substrate for a period of 60 seconds. The leakage current was measured to be less than 1 mA, fulfilling the safety requirements.

Figure 2:
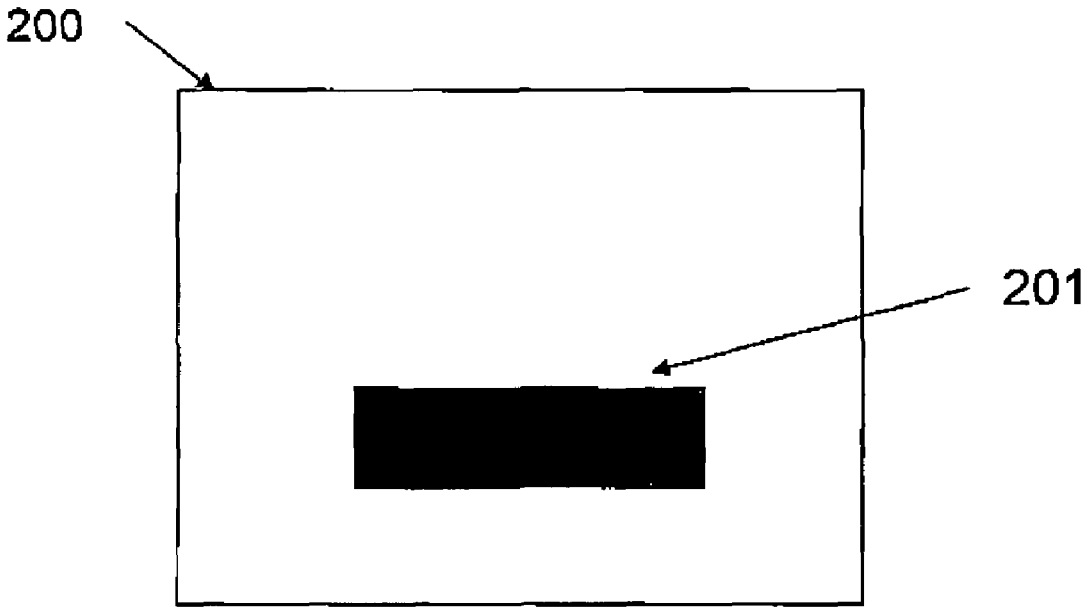
FIG. 2 is a conceptual view of an electrical domestic appliance including a heating element according to a representative embodiment.

FIG. 2 is a conceptual view of an electrical domestic appliance 200 including a heating element 201 according to a representative embodiment. The heating element is as described previously herein. The electrical domestic appliance 200 is, illustratively: an iron, a hair dryer, a hair styler, a steamer, a steam cleaner, a garment cleaner, a heated ironing board, a facial steamer, a kettle, a pressurized boiler for system irons and cleaners, a coffee maker, a deep fat fryer, a rice cooker, a sterilizer, a hot plate, a hot-pot, grill, a space heater, a waffle iron, a toaster, an oven, or a water heater.

The invention claimed is:

1. A heating element comprising an electrically insulating layer and an electrically conductive layer, wherein both the electrically insulating layer and the electrically conductive layer are based on a hybrid sol-gel precursor comprising at least one organosilane compound.

2. The heating element according to claim 1, wherein the at least one compound is from a group of alkyl-alkoxysilanes.

3. The heating element according to claim 1, wherein the electrically insulating layer comprises anisotropic, non-conductive particles.

4. The heating element according to claim 1, wherein the electrically conductive layer comprises conductive and/or semi-conductive particles, as well as an amount of insulating particles in a quantity of 0-20% by volume.

5. The heating element according to claim 4, wherein the electrically conductive layer comprises metal particles.

6. The heating element according to claim 5, wherein the electrically conductive layer comprises silver or silver alloy particles.

7. The heating element according to claim 4, wherein the electrically conductive layer comprises graphite or carbon-black particles.

8. The heating element according to claim 1, wherein the electrically conductive layer does not exceed 30 mm in thickness.

9. The heating element according to claim 1, wherein the insulating layer has a thickness of 25-100 mm.

10. The heating element according to claim 1, wherein the heating element is applied on an aluminum or aluminum alloy substrate.

11. An electrical domestic appliance, comprising:

a heating element, which comprises:

an electrically insulating layer; and an electrically conductive layer;

wherein both the electrically insulating layer and the electrically conductive layer are based on a hybrid sol-gel precursor comprising an organosilane compound.

12. The electrical domestic appliance according to claim 11, wherein the electrical domestic appliance is one of: an iron, a hair dryer, a hair styler, a steamer, a steam cleaner, a garment cleaner, a heated ironing board, a facial steamer, a kettle, a pressurized boiler for system irons and cleaners, a coffee maker, a deep fat fryer, a rice cooker, a sterilizer, a hot plate, a hot-pot, grill, a space heater, a waffle iron, a toaster, an oven, or a water heater.

13. The heating element of claim 1, wherein the electrically insulating layer comprises non-conductive particles having longest dimension of 2-500 micrometers, and wherein the non-conductive particles comprise 4-10% by volume of the electrically insulating layer.

14. The heating element of claim 1, wherein the electrically insulating layer comprises non-conductive flat-shaped particles having longest dimension of 2-500 micrometers, and further non-conductive particles in colloidal form.

15. The electrical domestic appliance of claim 11, wherein the electrically insulating layer comprises non-conductive particles having longest dimension of 2-500 micrometers, and wherein the non-conductive particles comprise 4-10% by volume of the electrically insulating layer.

16. The electrical domestic appliance of claim 11, wherein the electrically insulating layer comprises non-conductive flat-shaped particles having longest dimension of 2-500 micrometers, and further non-conductive particles in colloidal form.

17. The heating element of claim 1, wherein the at least one organosilane compound comprises at least one of methyltrimethoxysilane (MTMS) and methyl-triethoxysilane (MTES).

18. The heating element of claim 1, wherein the electrically conductive layer includes a different organosilane compound than the electrically insulating layer.

* * * * *